United States Patent [19]

Goss, Jr.

[11] 3,975,875

[45] Aug. 24, 1976

[54] DECORATIVE EXTERIOR TRIM SYSTEM FOR WINDOWS

[75] Inventor: Lorane C. Goss, Jr., Mechanicsburg, Pa.

[73] Assignee: Capitol Products Corporation, Mechanicsburg, Pa.

[22] Filed: Sept. 30, 1974

[21] Appl. No.: 510,399

[52] U.S. Cl. ..... 52/211; 52/287; 52/718

[51] Int. Cl.[2] ..... E06B 1/18

[58] Field of Search ..... 52/204, 213, 214, 211, 52/212, 403, 208, 716, 717, 718, 287, 288, 731; 49/504, DIG. 1

[56] References Cited

UNITED STATES PATENTS

| | | | |
|---|---|---|---|
| 1,825,010 | 9/1931 | Murphy | 52/718 X |
| 2,214,947 | 9/1940 | Wetzel | 52/214 X |
| 2,672,959 | 3/1954 | Young | 52/212 |
| 2,755,894 | 7/1956 | Weyl et al. | 52/204 X |
| 2,791,007 | 5/1957 | Kobil | 52/212 |
| 2,867,856 | 1/1959 | Cudini | 52/731 X |
| 2,871,524 | 2/1959 | Willie et al. | 52/211 |
| 2,976,972 | 3/1961 | Raymond | 52/717 |
| 2,996,767 | 8/1961 | Kobil et al. | 52/212 |
| 3,410,045 | 11/1968 | Meyer | 52/718 |
| 3,469,350 | 9/1969 | Lange | 52/213 X |
| 3,690,082 | 9/1972 | Byland | 52/213 |
| 3,851,433 | 12/1974 | Colucci | 52/717 X |

FOREIGN PATENTS OR APPLICATIONS

| | | | |
|---|---|---|---|
| 335,848 | 3/1959 | Switzerland | 49/DIG. 1 |

*Primary Examiner*—Ernest R. Purser
*Assistant Examiner*—Leslie A. Braun
*Attorney, Agent, or Firm*—Donald L. Johnson; John F. Sieberth; Paul H. Leonard

[57] ABSTRACT

A mechanical system for applying a decorative exterior trim around the perimeter of a fin type window frame. The system includes angular decorative trim shapes which fit into an integral groove on the exterior surface of the window frame and which are fastened to a nailing fin on the window frame.

10 Claims, 7 Drawing Figures

DECORATIVE EXTERIOR TRIM SYSTEM FOR WINDOWS

BACKGROUND OF THE INVENTION

The present invention is in the general field of building construction and relates more specifically to windows or window framing. Metal windows and especially aluminum windows are manufactured with two basic types of window frames, a box frame or a fin type frame. Both types of windows can be trimmed out or finished in various ways depending upon the particular type of building construction in which the window frame is to be installed and the esthetic effect to be achieved. Generally, box frame constructions are more attractive and more expensive. Box frame extrusions are also much more difficult to make than fin type window frame extrusions. In the usual home construction employing box frame aluminum windows, the windows are installed by nailing or screwing the box frame onto a supporting wood structure. In addition to leaving exposed nail heads or screw heads, installation frequently results in marring or other damage to the frame.

It is, therefore, a primary object of the present invention to provide a box frame construction for fin type windows, one which is economical and attractive in appearance and one which can be readily and easily installed.

Another object of the instant invention is to provide a box frame type exterior decorative trim on a fin type window after the basic building wall construction is complete and the window has been installed therein.

Still another object of the invention is to provide a box frame construction in which all window anchors or fasteners are completely concealed after installation is finished.

A further object of the invention is to provide a box frame window structure in which the exterior trim comprising said box frame can be constructed in a variety of designs or shapes.

Other objects and advantages of the invention will be more readily apparent from the drawings and description hereinafter.

SUMMARY OF THE INVENTION

The present invention provides a mechanical system for applying a decorative exterior trim around the perimeter of a fin type window frame. In effect, a box frame type construction is mounted on the fin type window frame. The system includes angular decorative trim pieces or shapes which are fitted into grooves made therefor on the exterior surface of the window frame and fastened or secured on the edges of the nailing fins by spring clips or other suitable fasteners. The trim pieces may be of various designs and can be made to simulate the appearance of standard wood trims. The trim shapes are mounted on header, jamb and sill nailing fins so as to form a complete box frame. Corner joints of the trim are accomplished by a simple overlap, mitering, machined fits or any other suitable manner. The trim shapes can be installed after the basic window wall construction is complete, i.e., the fin type window frame is mounted in the supporting wall structure.

The window frame may be constructed of metal or plastic, but aluminum extrusions are preferred. The trim pieces may also be constructed of metal or plastic as desired, including extruded plastic, molded plastic, extruded aluminum, roll-formed aluminum or roll-formed steel. The choice of designs and materials are almost limitless, with economics and esthetics being the primary determining factors.

DESCRIPTION OF THE PREFERRED EMBODIMENT

Figure 1:
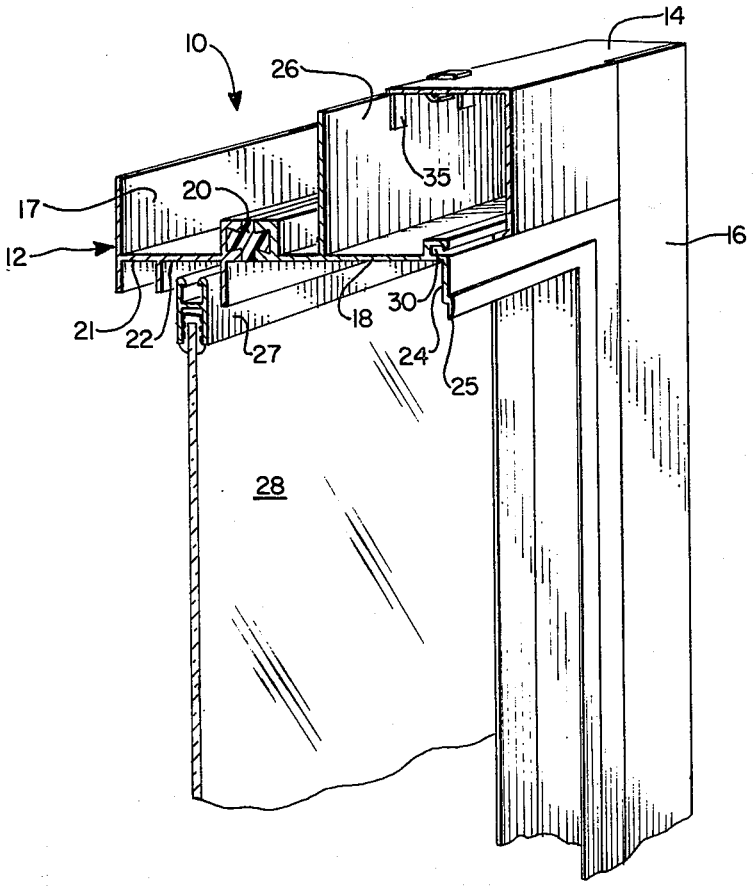
FIG. 1 is a perspective view of a partial section of a window with the decorative exterior trim installed thereon.

Referring to the drawings, particularly FIG. 1, a partial section of a window 10 comprising a standard fin type window frame 12 with decorative trim pieces or shapes 14 and 16 mounted thereon is shown. The window frame 12 comprises an interior portion 17 and an exterior member 18 separated by a thermal break 20. Sash tracks 21 and 22 are formed in the interior member 17. Extending at right angles from the exterior member 18 is a member 24 having a hook or lip 25 on the end thereof. A nailing fin 26 extends perpendicularly from the exterior member 18 between the thermal break 20 and the end member 24. A sash rail 27 with a glass panel 28 mounted therein is mounted in the track 22. The window construction as described up to this point is substantially that of a customary one.

The thermal break 20 is illustrative only of one particular type of thermal break. Any other desired type of thermal break construction may be used or such thermal break may be eliminated altogether.

Figure 7:
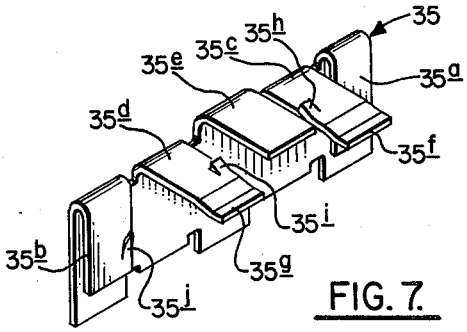

In order to accommodate the frame 12 for receiving the trim piece 14, a groove 30 is formed on the exterior member 18 opposite the end member 24. The trim piece 14 is mounted on the frame 12 by inserting one end of the trim piece to the nailing fin 26 by means of the clip 35, which will be explained in more detail hereinafter. The clip 35 is illustrated in detail in FIG. 7. The trim piece 16 is similarly mounted onto a jamb similarly constructed to the head 12 in the same manner as the trim piece 14. A plurality of the spring clips 35 are used to fasten the trim pieces to the nailing fins. The spring clips are preferably made from painted tempered spring steel with a minimum of two being used per each side of the window. A sufficient number of clips should be used to secure adequate fastening of the trim to the sides of the window.

Figure 6:
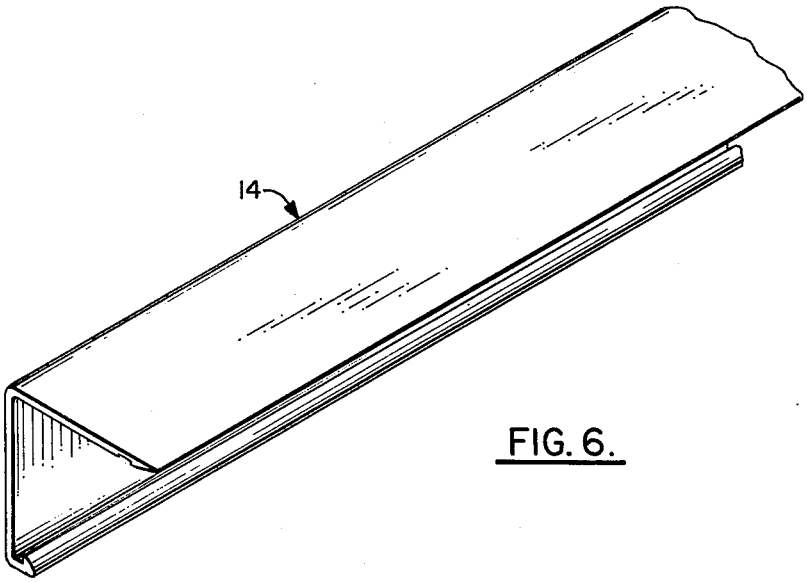
FIG. 6 is a perspective view of a typical decorative trim shape suitable for use in the present invention and illustrated in FIGS. 1 and 2; and, FIG. 7 is a perspective view of one type of clip suitable for use in connecting a decorative trim shape to a window.

The trim pieces 14 and 16 are of a simple flat angular design as illustrated in the FIG. 6. With this simple type of construction, a simple overlap corner joint may be obtained. In such case, the trim piece 16 overlaps the trim piece 14. The overlap can, of course, be reversed, with the piece 14 overlapping the piece 16. Additional trim pieces are similarly mounted on the remaining jamb and sill in order to completely form a box-like frame around the window.

Figure 2:
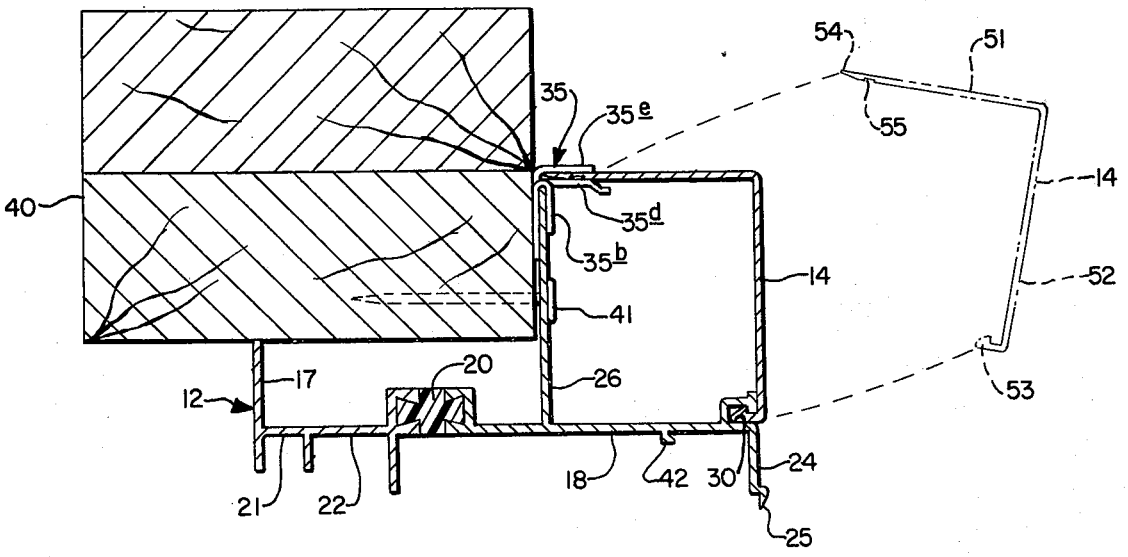
FIG. 2 is a sectional view of a window header showing the decorative exterior trim just prior to installation and after being installed on the header.

As best seen in FIG. 2, the frame 12 is mounted on a double header 40 in the customary manner by securing or fastening the nailing fin 26 to the header with nails 41. The exterior member 18 also has a glazing holder 42 formed thereon.

The trim piece 14 is comprised of legs 51 and 52 joined together at right angles to form a simple flat angular design. A hook or lip 53 is formed on the end of the leg 52 and is so constructed as to be lockedly received by the groove 30 of the frame 12. The other leg 51 of the shape 14 has a tapered end 54 with a small groove 55 therein, and is so consctructed as to be readily received by the clip 35.

In trimming out a window, the trim piece 14 is preferably mounted on the head 12 after the frame has been mounted on the double header 40 or supporting window construction. The desired number of spring clips 35 are inserted or snapped on the nailing fin 26 with the U-shaped members 35*a* and 35*b* on each end of the clip being fastened onto the nailing fin 26. Subsequently, the hook 53 of the trim piece 14 is inserted in the groove 30, and the end 54 is inserted in the clip 35 as illustrated in FIG. 2. The end 54 is inserted in the clip 35 between the angular members 35*c* and 35*d* and the angular member 35*e*. The ends 35*f* and 35*g* of the right angle members 35*c* and 35*d*, respectively, are bent downwardly so as to facilitate the reception of the trim piece. The angular members in effect provide a clip for receiving the trim shape. The members 35*c* and 35*e* also have barbs 35*h* and 35*i*, respectively, protruding thereon for assisting in the retention of the clip on the trim piece. Similar barbs 35*j* and 35*k* (not seen) are formed on the U-shaped members 35*b* and 35*a*, respectively, which protrude inwardly to further secure the clip 35 on the nailing fin. It can readily be appreciated that other types of suitable fasteners may be used in the invention.

Figure 3:
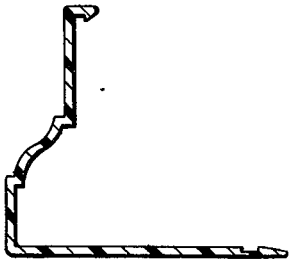
FIGS. 3–5 are sectional views of alternate decorative trim shapes suitable for use in the instant invention.
Figure 4:
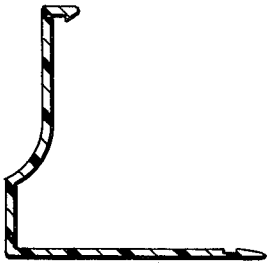
Figure 5:
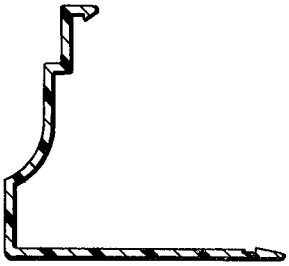

FIGS. 3, 4, and 5 illustrate alternative designs of trim shapes. The designs shown have the same type of fastening ends as the trim piece 14. Various designs as well as various end or leg constructions can also be used in the instant invention. Such complicated design shapes as illustrated in FIGS. 3, 4, and 5 cannot be installed with a simple overlap fit on the corners, but must be mitered or machine fit to provide the desired box frame construction. All of such corner constructions are well within the skill of the normal craftsman.

Aluminum is defined herein as including aluminum and aluminum alloys which have sufficient structural integrity to be employed in the manufacture of windows and window frames, and those aluminum materials customarily employed in the aluminum construction area.

Plastic is defined in the usual sense and includes those plastics having sufficient structural integrity to be used as decorative exterior trim, and those plastic materials customarily employed in the manufacture of windows and window frames. Some suitable plastics are PVC, ABS, styrene, polyethylene, polyurethane, fiberglass, and reinforced plastic.

The present invention provides a novel system for constructing a box frame type window. A snap-on molding is provided which can quickly and easily be installed. No tools are needed for installation. The trim shapes can be constructed in standard sizes or any other desired size or predetermined length. Such trim shapes can be made of various angular designs to achieve a desired esthetic effect. The trim shapes can readily be cut to size to fit the perimeter of any size fin type window frame.

The installation clips can be painted or otherwise colored the same color as the trim shapes. The clips are also of such a size that they can easily be covered by normal caulking of the window upon installation thereof. In either case, a box frame is provided which has a distinct improvement in appearance over the usual box frame window constructions wherein nails or other fasteners are inserted in the box frame and which fastener heads are exposed to viewing. Should the molding or decorative trim be damaged after installation, it can readily be removed and new trim or molding fastened to the window frame. Such repair can be made without removing or damaging the fin type window frame.

The foregoing disclosure and description of the invention is merely illustrative and explanatory thereof, and various changes in the size, shape, and materials, as well as in the details of the illustrated construction, may be made within the scope of the appended claims without departing from the spirit of the invention.

What is claimed is:

1. An exterior decorative trim system for fin type window frames: comprising, a window frame having a nailing fin thereon, an elongated angular trim shape adapted to be positioned on said window frame, groove means integrally formed on said window frame for receiving insertion means on one end of said trim shape, insertion means on said one end of said trim shape for insertion in said groove receiving means on said window frame, clip means for fastening the other end of said trim shape to said nailing fin on said window frame, a first means on said clip means for clip-on fastening of said clip means on said nailing fin of said window frame, a second means on said clip means for clip-on fastening of said clip means on said other end of said trim shape, means on said other end of said trim shape for insertion into said second fastening means on said clip means, said clip means being a unitary member and said first fastening means and said second fastening means being integrally formed thereon, and said second fastening means extending angularly from said first fastening means, whereby, when said one end of said trim shape is inserted in said groove receiving means on said window frame, and said clip means is fastened on said nailing fin and on said other end of said trim shape, said trim shape is locked on said window frame and forms a box-like frame thereon.

2. The decorative trim system of claim 1, wherein said elongated trim shape is of a flat angular construction.

3. The decorative trim system of claim 1, wherein said trim shape is of an angular design and a face thereof is shaped in a decorative design.

4. The decorative trim system of claim 1, wherein the means on said one end of said trim shape for receiving said groove means on said window is a hook shaped projection extending logitudinally the length of said trim shape.

5. The decorative trim system of claim 1, wherein the means on said other end of said trim shape for insertion in said clip means has a tapered end and a groove thereon extending longitudinally the length of said trim shape.

6. The decorative trim system of claim 1, wherein a plurality of said trim shapes are positioned peripherally on said window frame to form the box-like frame on all sides of said fin type window.

7. The decorative trim system of claim 1, wherein said trim shape consists of a pair of integrally formed legs extending the length thereof and joined to each other, means on the end of one leg of said trim shape extending the length thereof and adapted for being lockedly inserted in said groove means on said window frame and means on the end of said other leg of said trim shape extending the length thereof and adapted for being lockedly inserted in said clip means.

8. The decorative trim system of claim 1, wherein said first fastening means on said clip means comprises a pair of U-shaped members on each end of said clip means adapted to be snapped on or clipped on said nailing fin and thereby secure said clip means to said nailing fin.

9. The decorative trim system of claim 1, wherein said second fastening means on said clip means comprises a plurality of angularly extending members which form a clip whereby said other end of said trim shape may be inserted therein and secured thereto.

10. The decorative trim system of claim 1, comprising a plurality of said clip means.

* * * * *